US006689029B2

(12) United States Patent
Wakeman

(10) Patent No.: US 6,689,029 B2
(45) Date of Patent: Feb. 10, 2004

(54) MEDICAL AID AND APPARATUS FOR ENHANCING SEXUAL INTIMACY

(76) Inventor: Karl Wakeman, Sable Palm La., Apt. #3505H, Titusville, FL (US) 32780

( * ) Notice: Subject to any disclaimer, the term of this patent is extended or adjusted under 35 U.S.C. 154(b) by 62 days.

(21) Appl. No.: 10/122,910

(22) Filed: Apr. 12, 2002

(65) Prior Publication Data

US 2003/0195097 A1 Oct. 16, 2003

(51) Int. Cl.[7] ..... A63B 71/00

(52) U.S. Cl. ..... 482/148; 482/142; 482/907; 482/904; 128/845; 128/846

(58) Field of Search ..... 482/142, 903, 482/148, 904, 907; 601/24, 46, 48, 49; 128/845–846; 600/38

(56) References Cited

U.S. PATENT DOCUMENTS

| | | | | |
|---|---|---|---|---|
| 2,550,841 A | | 5/1951 | Martinez | |
| 3,164,150 A | | 1/1965 | Reid | |
| 3,678,923 A | | 7/1972 | Oetinger | |
| 3,712,613 A | | 1/1973 | Feather et al. | |
| D275,913 S | | 10/1984 | Mulligan | |
| 5,022,384 A | * | 6/1991 | Freels et al. | 128/33 |
| 5,385,154 A | * | 1/1995 | Fuhrman et al. | 128/845 |
| 5,389,062 A | * | 2/1995 | Mitchum | 600/38 |
| 5,443,532 A | * | 8/1995 | Hudak | 5/652 |
| 5,730,707 A | * | 3/1998 | Vang | 601/49 |
| 5,776,037 A | * | 7/1998 | Millington | 482/91 |
| 6,056,707 A | | 5/2000 | Hayashi | |

* cited by examiner

*Primary Examiner*—Nicholas D. Lucchesi
*Assistant Examiner*—L Amerson

(57) ABSTRACT

A medical aid and apparatus for enhancing sexual intimacy for facilitating a gynecological examination or performance of the marital act. The medical aid and apparatus includes a pair of main tubular support members, each includes a first, second, and third extents, the first extent is operationally coupled to a proximal end of the second extent, the third extent is operationally coupled to a distal end of the second extent, the main tubular members are positioned in a spaced parallel relationship and provide vertical support for the apparatus; and a main platform member operationally coupled to the pair of main tubular members, the main platform member which includes a first surface, the main platform member is positioned such that the first platform surface is substantially above a surface of the second extents of the pair of main tubular member, the main platform is designed for supporting a first user.

19 Claims, 4 Drawing Sheets

MEDICAL AID AND APPARATUS FOR ENHANCING SEXUAL INTIMACY

BACKGROUND OF THE INVENTION

1. Field of the Invention

The present invention relates to medical aids and more particularly pertains to a new medical aid and apparatus for enhancing sexual intimacy for providing support to a first user in various positions while facilitating access by a second user.

2. Description of the Prior Art

The use of medical aids is known in the prior art. U.S. Pat. No. 5,443,532 describes an apparatus for enhancing sexual intimacy. Another type of medical aids is U.S. Pat. No. 3,813,091 having a knockdown couch mechanism.

While these devices fulfill their respective, particular objectives and requirements, the need remains for a device has certain improved features such a pivotal support and height adjustments for facilitating unobstructed access.

SUMMARY OF THE INVENTION

The present invention meets the needs presented above by providing multiple support platforms having adjustable inclines and height adjustments for stand portions.

Still yet another object of the present invention is to provide a new medical aid and apparatus for enhancing sexual intimacy that provides adjustable user support for gynecological examinations.

Even still another object of the present invention is to provide a new medical aid and apparatus for enhancing sexual intimacy that provides body support while consummating an act of marital union.

To this end, the present invention generally comprises a pair of main tubular support members, each includes a first, second, and third extents, the second extent includes a distal and a proximal end, the first extent is operationally coupled to the proximal end of the second extent, the third extent is operationally coupled to the distal end of the second extent, the main tubular members is positioned in a spaced substantially parallel relationship, the main tubular members provides vertical support for the apparatus; and a main platform member operationally coupled to the pair of main tubular members, the main platform member which includes a first surface, the main platform member is positioned such that the first platform surface is substantially above a surface of the second extents of the pair of main tubular member, the main platform is designed for supporting a first user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
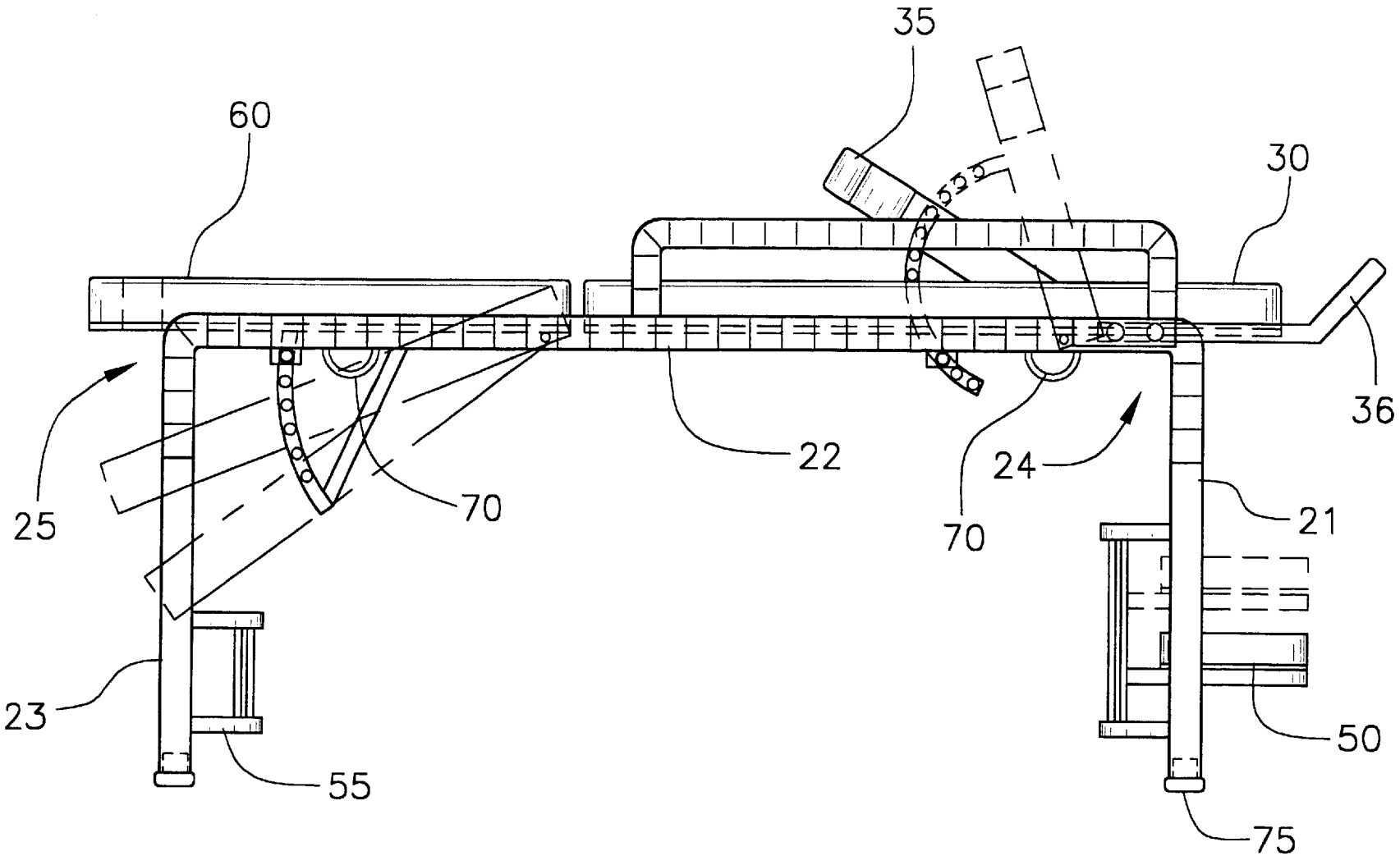
FIG. 1 is a schematic front view of a new medical aid and apparatus for enhancing sexual intimacy according to the present invention.
Figure 2:
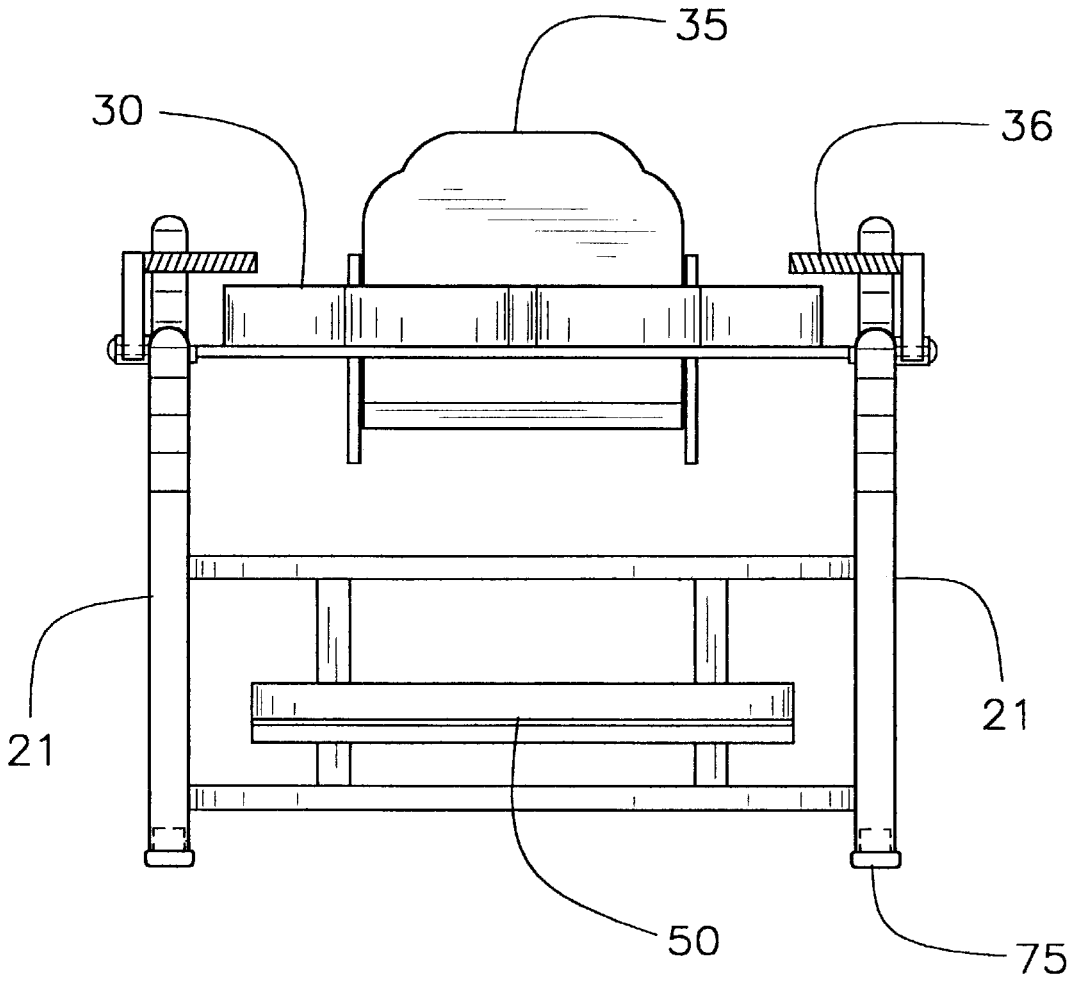
FIG. 2 is a schematic side view of the present invention.
Figure 3:
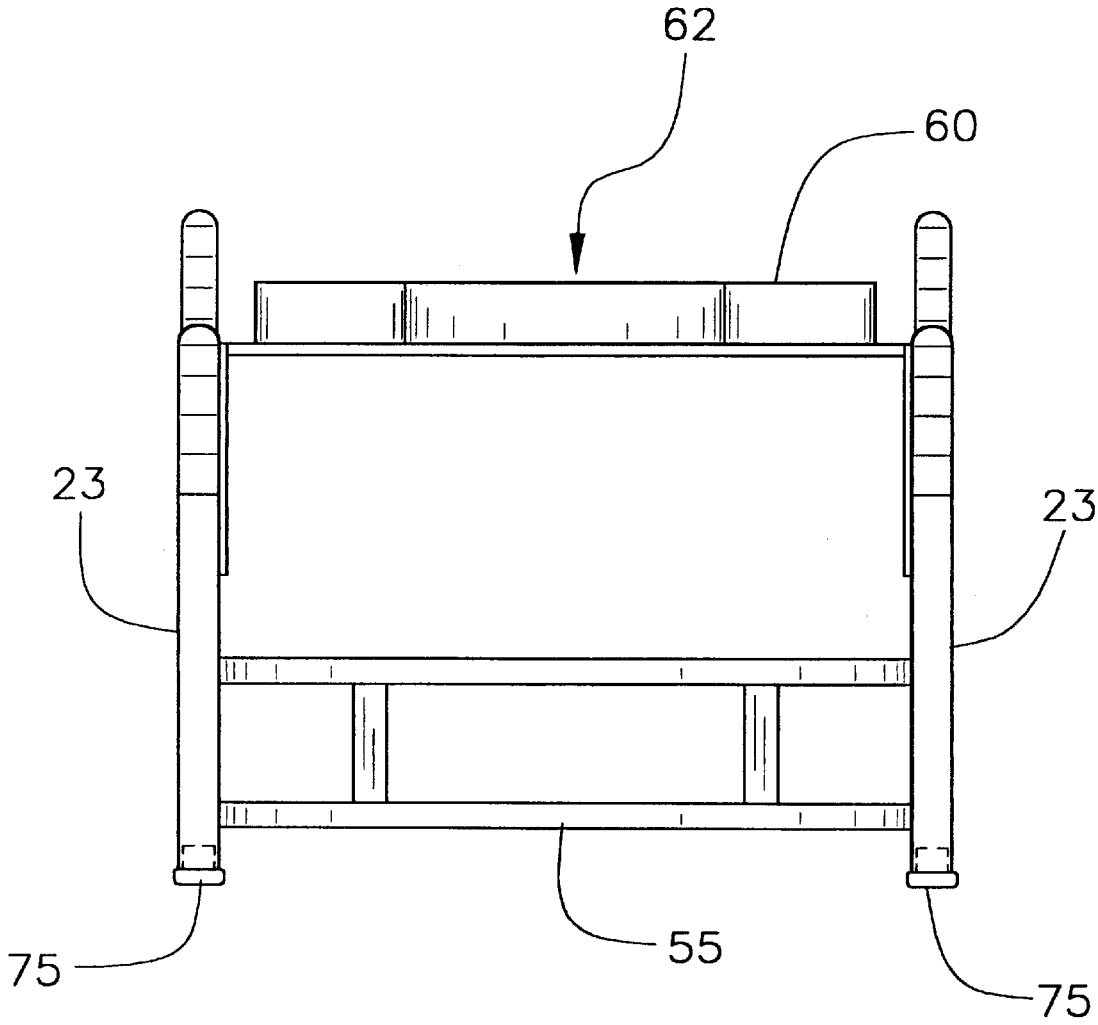
FIG. 3 is a schematic side view of the present invention.
Figure 4:
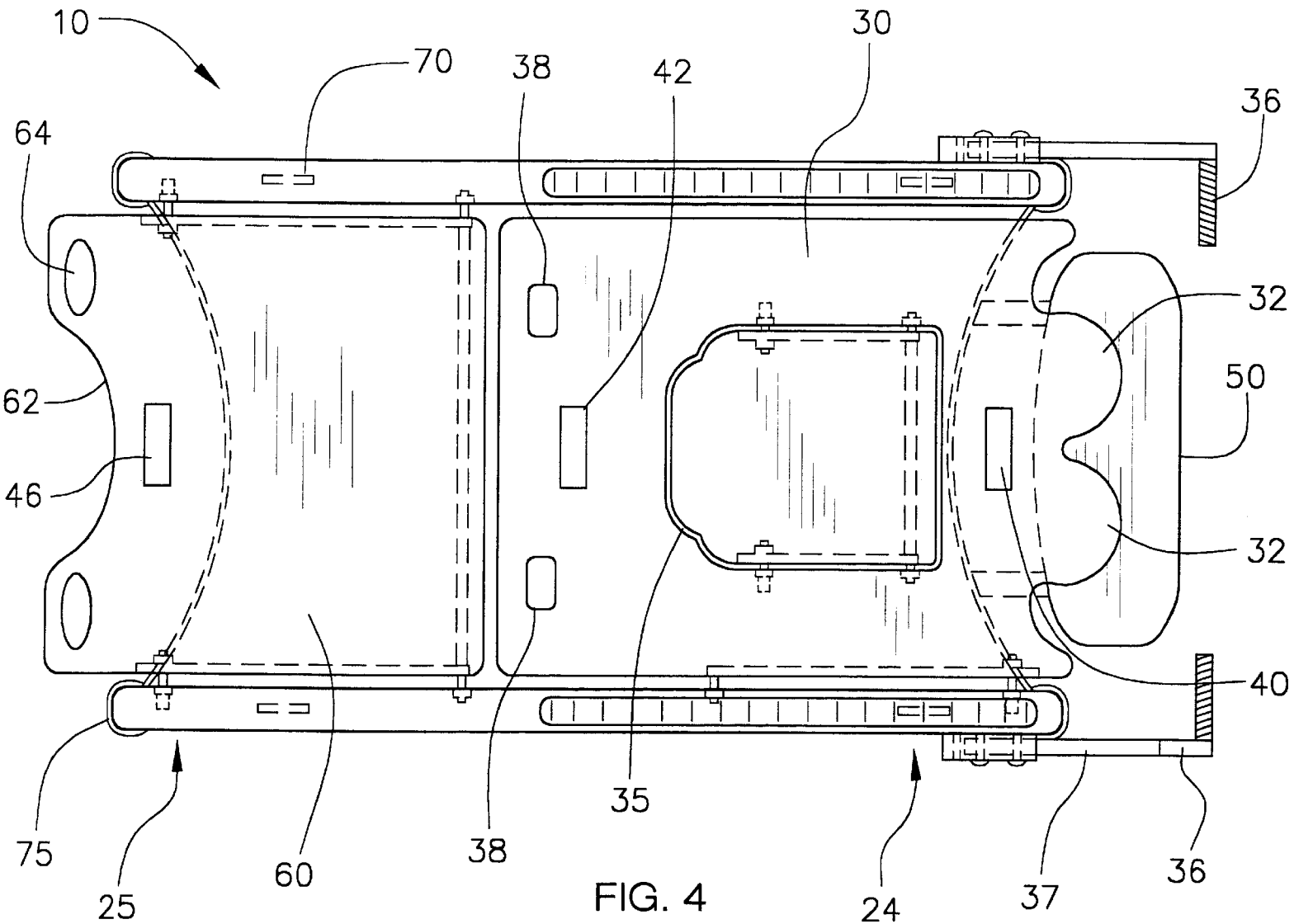
FIG. 4 is a schematic top view of the present invention.

With reference now to the drawings, and in particular to FIGS. 1 through 4 thereof, a new medical aid and apparatus for enhancing sexual intimacy embodying the principles and concepts of the present invention and generally designated by the reference numeral 10 will be described.

As best illustrated in FIGS. 1 through 4, the medical aid and apparatus for enhancing sexual intimacy 10 generally comprises a pair of main tubular support members 20, and a main support platform 30.

Each one of the pair of main tubular support members 20 includes a first 21, second 22 and third extents 23. The second extent 22 includes a distal 24 and a proximal end 25. The first extent 21 is operationally coupled to the proximal end 25 of the second extent 22. The third extent 23 is operationally coupled to the distal end 25 of the second extent 22. The first extent 21 includes a longitudinal axis. The second extent 22 includes a second longitudinal axis. The third extent 23 includes a third longitudinal axis. The first 21 and third extents 23 are positioned such that the longitudinal axis and the third longitudinal axis have a spaced substantially parallel relationship. The first 21 and third extents 23 are positioned such that the longitudinal axis and the third longitudinal axis each includes a substantially perpendicular relationship with the second longitudinal axis. The main tubular members 20 are positioned in a spaced substantially parallel relationship. The main tubular members 20 provide vertical support for the apparatus 10.

The main platform member 30 is operationally coupled to the pair of main tubular members 20. The main platform member 30 is positioned adjacent to the proximal ends 24 of the pair of main tubular members 20. The main platform member 30 includes a first platform surface 31. The main platform member 30 is positioned such that the first platform surface 31 is substantially above a surface of the second extents 22 of the pair of main tubular members 20. The main platform 30 is designed for supporting a first user.

The main platform member 30 includes a pair of arcuate support sections 32 extending outwardly from the main platform member 30. The arcuate support sections 32 are designed for supporting the buttocks of a first user such that the main platform member 30 provides unobstructed vaginal access during use.

A vibrating means 40 is preferably positioned adjacent to a proximal end of the main platform member 30. The vibrating means 40 provides external stimulation to the lower pubic regions of a first user.

A first back rest portion 35 may be pivotally coupled to the main platform member 30. The first back rest portion 30 provides support to a back of a first user when seated upon the main platform member 30.

A stand member 50 is prefereably slideably coupled to the pair of main tubular support members 20. A height of the stand member 50 is adjustable for facilitating vaginal access of first user by a second user when standing on the stand member 50.

In a preferred embodiment, a pair of leg support members 36 may be pivotally coupled to the proximal ends 24 of the main tubular support members 20. The pair of leg support members 36 is for supporting legs of a first user when the first user resting upon the main platform member 30.

In a further embodiment, each one of a pair of leg padding members 37 substantially envelopes an associated one of the pair of leg support members 36. The leg padding members 37 provide cushioning for the legs of the user.

In still a further embodiment, the main platform member 30 includes a pair of apertures 38 extending therethrough. Each one of the apertures 38 is positioned adjacent to the distal end of the main platform member 30. Each one of the apertures is positioned adjacent an associated side of the main platform member 30. The pair of apertures 38 provide handholds for a first user.

In yet a further embodiment the main platform member 30 further comprising a second vibrating means 42 positioned adjacent to the distal end of the main platform member 30. The second vibrating means 42 includes a lateral axis. The second vibrating means 42 is positioned such that the lateral axis is substantially collinear with a longitudinal axis of the main platform member 30. The second vibrating means 30 providing external stimulation to a user.

Each one of the pair of main tubular support members 20 may include a padded covering portion 28 substantially enveloping the second extents 22. The padded covering portion 28 provides cushioning for a user resting upon the main tubular support members 20.

In still yet a further embodiment, a second platform member 60 may be operationally coupled to the pair of main tubular support members 20. The second platform member 60 is positioned adjacent to the distal end 25 of the pair of main tubular support members 20. The second platform member 60 is pivotally coupled to the pair of main tubular support members 20. The second platform member 60 includes a distal end. The second platform member 60 is pivotal such that a first surface of the distal end of the second platform member 60 is positionable substantially below a first surface of the second extents 22 of the pair of main tubular support members 20.

In an embodiment, the second platform member 60 includes a concave section 62 positioned medially adjacent to the distal end of the second platform member 60. The concave section 62 is for facilitating unobstructed vaginal and anal access by a second user.

The second platform member 60 includes a pair of second apertures 64 extending therethrough. The second apertures 64 are positioned adjacent to the distal end of the second platform 60. Each one of the second apertures 64 is positioned adjacent to an associated side of the second platform member 60. The second apertures 64 providing foot holds for a first user. The foot holds of the second platform member 60 may be used in conjunction with the handholds of the main support platform 30.

In a further embodiment, a second stand platform 55 may be slideably coupled to the third extents 23 of the pair of main tubular support members 20. The second stand platform 55 includes a height adjustable for facilitating vaginal and anal access of a first user by a second user when standing on the second stand platform 55.

A third vibration means 46 may be positioned medially adjacent to the concave section 62. The third vibration means 46 provides external stimulation to the lower pubic regions of a first user when the first user rests upon the second platform member 60.

A plurality of restraint receiving rings 70 may be coupled to the pair of main tubular support members 20. The plurality of restraint receiving rings 70 facilitate coupling user restraints to the apparatus 10. Thus, the mobility of a first user is restricted by the restraints.

In still yet a further embodiment, each one of a plurality of elastomeric pad members 75 is coupled to an associated end of the pair of main tubular support members 20. The plurality of elastomeric pad members 75 are used to enhance friction and inhibit sliding of the medical aid and apparatus 10 during use.

In use, a first and second user determine the appropriate position for the first user. The first user is then positioned on the main support platform or the second platform member as desired. The second user may utilize the restraint receiving rings to coupled restraints to the medical aid and apparatus and restrain the first user as desired. The second user then positions themselves relative to the apparatus as appropriate for a gynecological exam or for facilitating of the act of marital union.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A medical aid and apparatus for enhancing sexual intimacy comprising:

a pair of main tubular support members, each one of said pair of main tubular support members having a first, second, and third extents, said second extent having a distal and a proximal end, said first extent being operationally coupled to said proximal end of said second extent, said third extent being operationally coupled to said distal end of said second extent, said first having a longitudinal axis, said second extent having a second longitudinal axis, said third extent having a third longitudinal axis, said first and third extents being portioned such that said longitudinal axis and said third longitudinal axis having a spaced substantially parallel relationship, said first and third extents being positioned such that said longitudinal axis and said third longitudinal axis each having a substantially perpendicular relationship with said second longitudinal axis, said main tubular members being positioned in a spaced substantially parallel relationship, said main tubular members providing vertical support for said apparatus;

a main platform member operationally coupled to said pair of main tubular members, said main platform member being positioned adjacent to said proximal ends of said pair of main tubular members, said main platform member having a first surface, said main platform member being positioned such that said first platform surface being substantially above a surface of said second extents of said pair of main tubular member, said main platform being adapted for supporting a first user; and a second platform member operationally coupled to said pair of main tubular support members, said second platform member being positioned adjacent to said distal end of said pair of main tubular support members, said second platform member being pivotally coupled to said pair of main tubular support members, said second platform member having a distal end, said second platform member being pivotal such that a first surface of said distal end of said second platform member being positionable substantially below a first surface of said second extents of said pair of main tubular support members.

2. The medical aid and apparatus of claim 1, wherein said main platform member having a pair of arcuate support sections extending outwardly from said main platform member, said arcuate support section being adapted for supporting the buttocks of a first user such that said main platform member provides unobstructed vaginal access during use.

3. The medical aid and apparatus of claim 1, wherein said main platform member having a vibrating means positioned adjacent to a proximal end of said main platform member, said vibrating means providing external stimulation to the lower pubic regions of a first user.

4. The medical aid and apparatus of claim 1 further comprising a first back rest portion pivotally coupled to said main platform member, said first back rest portion providing support to a back of a first user when seated upon said main platform member.

5. The medical aid and apparatus of claim 1, further comprising a stand member slideably coupled to said pair of main tubular support members, a height of said stand member being adjustable for facilitating vaginal access of first user by a second user when standing on said stand member.

6. The medical aid and apparatus of claim 1, further comprising a pair of leg support members pivotally coupled to said proximal ends of said main tubular support members, said pair of leg support members being for supporting legs of a first user when said first user resting upon said main platform member.

7. The medical aid and apparatus of claim 6, further comprising a pair of leg padding members, each one of said pair of leg padding members substantially enveloping an associated one of said pair of leg support members, said leg padding members providing cushioning for the legs of the user.

8. The medical aid and apparatus of claim 1, wherein said main platform member having a pair of apertures extending therethrough, said one of said apertures being positioned adjacent to said distal end of said main platform member, each one of said apertures being positioned adjacent an associated side of said main platform member, said pair of apertures providing handholds for a first user.

9. The medical aid and apparatus of claim 1, wherein said main platform member further comprising a second vibrating means positioned adjacent to said distal end of said main platform member, said second vibrating member having a lateral axis said second vibrating means being positioned such that said lateral axis being substantially collinear with a longitudinal axis of said main platform member, said second vibrating means providing external stimulation to a user.

10. The medical aid and apparatus of claim 1 wherein each one of said pair of main tubular support members having a padded covering portion substantially enveloping said second extents, said padded covering portion providing cushioning for a user resting upon said main tubular support members.

11. A medical aid and apparatus for enhancing sexual intimacy comprising:

a pair of main tubular support members, each one of said pair of main tubular support members having a first, second, and third extents, said second extent having a distal and a proximal end, said first extent being operationally coupled to said proximal end of said second extent, said third extent being operationally coupled to said distal end of said second extent, said first having a longitudinal axis, said second extent having a second longitudinal axis, said third extent having a third longitudinal axis, said first and third extents being portioned such that said longitudinal axis and said third longitudinal axis having a spaced substantially parallel relationship, said first and third extents being positioned such that said longitudinal axis and said third longitudinal axis each having a substantially perpendicular relationship with said second longitudinal axis, said main tubular members being positioned in a spaced substantially parallel relationship, said main tubular members providing vertical support for said apparatus;

a main platform member operationally coupled to said pair of main tubular members, said main platform member being positioned adjacent to said proximal ends of said pair of main tabular members, said main platform member having a first surface, said main platform member being positioned such that said first platform surface being substantially above a surface of said second extents of said pair of main tubular member, said main platform being adapted for supporting a first user;

said main platform member having a pair of arcuate support sections extending outwardly from said main platform member, said arcuate support section being adapted for supporting the buttocks of a first user such that said main platform member provides unobstructed vaginal access during use;

a vibrating means positioned adjacent to a proximal end of said main platform member, said vibrating means providing external stimulation to the lower pubic regions of a first user;

a first back rest portion pivotally coupled to said main platform member, said first back rest portion providing support to a back of a first user when seated upon said main platform member;

a stand member slideably coupled to said pair of main tubular support members, a height of said stand member being adjustable for facilitating vaginal access of first user by a second user when standing on said stand member;

comprising a pair of leg support members pivotally coupled to said proximal ends of said main tubular support members, said pair of leg support members being for supporting legs of a first user when said first user resting upon said main platform member;

a pair of leg padding members, each one of said pair of leg padding members substantially enveloping an associated one of said pair of leg support members, said leg padding members providing cushioning for the legs of the user;

wherein said main platform member having a pair of apertures extending therethrough, said one of said apertures being positioned adjacent to said distal end of said main platform member, each one of said apertures being positioned adjacent an associated side of said main platform member, said pair of apertures providing handholds for a first user;

wherein said main platform member further comprising a second vibrating means positioned adjacent to said distal end of said main platform member, said second vibrating member having a lateral axis said second vibrating means being positioned such that said lateral axis being substantially collinear with a longitudinal axis of said main platform member, said second vibrating means providing external stimulation to a user; and each one of said pair of main tubular support members having a padded covering portion substantially enveloping said second extents, said padded covering portion providing cushioning for a user resting upon said main tubular support members.

12. The medical aid and apparatus of claim 1, wherein said second platform member having a concave section positioned medially adjacent to said distal end of said second platform member, said concave section facilitating unobstructed vaginal and anal access by a second user.

13. The medical aid and apparatus of claim 12, wherein said second platform member having a pair of second apertures extending therethrough said second apertures being positioned adjacent to said distal end of said second platform, each one of said second apertures being positioned adjacent to an associated side of said second platform member said second apertures providing foot holds for a first user.

14. The medical aid and apparatus of claim 12, further comprising a second stand platform slideably coupled to said third extents of said pair of main tubular support members, said second stand platform having a height adjustable for facilitating vaginal and anal access of a first user by a second user when standing on said second stand platform.

15. The medical aid and apparatus of claim 12, further comprising a third vibration means positioned medially adjacent to said concave section, said third vibration means providing external stimulation to the lower pubic regions of a first user when said first user rests upon said second platform member.

16. The medical aid and apparatus of claim 1, further comprising:

said second platform member having a concave section positioned medially adjacent to said distal end of said second platform member, said concave section facilitating unobstructed vaginal and anal access by a second user;

said second platform member having a pair of second apertures extending therethrough said second apertures being positioned adjacent to said distal end of said second platform, each one of said second apertures being positioned adjacent to an associated side of said second platform member said second apertures providing foot holds for a first user;

a second stand platform slideably coupled to said third extents of said pair of main tubular support members, said second stand platform having a height adjustable for facilitating vaginal and anal access of a first user by a second user when standing on said second stand platform; and a third vibration means positioned medially adjacent to said concave section, said third vibration means providing external stimulation to the lower pubic regions of a first user when said first user rests upon said second platform member.

17. The medical aid and apparatus of claim 1, further comprising a plurality of restraint receiving rings coupled to said pair of main tubular support members, said plurality of restraint receiving rings facilitating coupling user restraints to said apparatus whereby the mobility of a first user is restricted by the restraints.

18. The medical aid and apparatus if claim 1, further comprising a plurality of elastomeric pad members, said one of said plurality of elatomeric par members being coupled to an associated end of said pair of main tubular support members, said plurality of elastomeric pad members enhancing friction and inhibiting sliding of said medical aid and apparatus during use.

19. The medical aid and apparatus of claim 11, further comprising:

a second platform member operationally coupled to said pair of main tubular support members, said second platform member being positioned adjacent to said distal end of said pair of main tubular support members, said second platform member being pivotally coupled to said pair of main tubular support members, said second platform member having a distal end, said second platform member being pivotal such that a first surface of said distal end of said second platform member being positionable substantially below a first surface of said second extents of said pair of main tubular support members;

said second platform member having a concave section positioned medially adjacent to said distal end of said second platform member, said concave section facilitating unobstructed vaginal and anal access by a second user;

said second platform member having a pair of second apertures extending therethrough said second apertures being positioned adjacent to said distal end of said second platform, each one of said second apertures being positioned adjacent to an associated side of said second platform member said second apertures providing foot holds for a first user;

a second stand platform slideably coupled to said third extents of said pair of main tubular support members, said second stand platform having a height adjustable for facilitating vaginal and anal access of a first user by a second user when standing on said second stand platform;

a third vibration means positioned medially adjacent to said concave section, said third vibration means providing external stimulation to the lower pubic regions of a first user when said first user rests upon said second platform member;

a plurality of restraint receiving rings coupled to said pair of main tubular support members, said plurality of restraint receiving rings facilitating coupling user restraints to said apparatus whereby the mobility of a first user is restricted by the restraints; and a plurality of elastomeric pad members, said one of said plurality of elatomeric par members being coupled to an associated end of said pair of main tubular support members, said plurality of elastomeric pad members enhancing friction and inhibiting sliding of said medical aid and apparatus during use.

* * * * *